United States Patent [19]

Stern et al.

[11] Patent Number: 4,749,966

[45] Date of Patent: Jun. 7, 1988

[54] MILLIMETER WAVE MICROSTRIP CIRCULATOR

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 68,394

[22] Filed: Jul. 1, 1987

[51] Int. Cl.[4] ..... H01P 1/387

[52] U.S. Cl. ..... 333/1.1; 333/238

[58] Field of Search ..... 333/1.1

[56] References Cited

U.S. PATENT DOCUMENTS

| | | | |
|---|---|---|---|
| 3,341,789 | 9/1967 | Goodman et al. | 333/1.1 |
| 3,456,213 | 7/1969 | Hershenov | 333/1.1 |
| 4,415,871 | 11/1983 | Stern et al. | 333/1.1 |
| 4,538,123 | 8/1985 | Mariani et al. | 333/1.1 X |

OTHER PUBLICATIONS

Hershenov, "X-Band Microstrip Circulator," pp. 2022–2023, Proceedings of the IEEE, DEC. 1966.

*Primary Examiner*—Paul Gensler

*Attorney, Agent, or Firm*—Sheldon Kanars; Robert A. Maikis

[57] ABSTRACT

A millimeter wave microstrip Y-junction circulator is provided comprising a monolithic, wye-shaped ferrite element disposed on one surface of a section of microstrip dielectric substrate having three, Y-junction oriented sections of microstrip conductor on the same one substrate surface and an electrically conductive ground plane on the opposite substrate surface. The ferrite element has a central right prism-shaped portion with two equilateral triangular-shaped prism bases and three rectangular prism faces and three downwardly-sloping arm portions which extend radially outwardly from the prism faces of the central portion. The top base of the ferrite element central portion and the top surface of the ferrite arm portions which do not rest on the substrate are provided with microstrip conductors which cooperate with the ground plane to convey millimeter wave signals applied to the three Y-junction oriented microstrip sections on the substrate to the ferrite element central portion. A permanent magnet mounted on the ground plane beneath the bottom prism base causes the ferrite element central portion to act as a circulator to selectively couple the three microstrip sections on the substrate.

5 Claims, 3 Drawing Sheets

MILLIMETER WAVE MICROSTRIP CIRCULATOR

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to microstrip transmission lines operating in the millimeter wave region of the frequency spectrum and more particularly to a microstrip Y-junction circulator for use with such microstrip transmission lines.

2. Description of the Prior Art

Y-junction circulators are non-reciprocal coupling devices having three ports which provide signal transmission from one port to an adjacent port while decoupling the signal from the remaining port. They are used in radar system front ends as duplexers to couple the transmitter and receiver to the single radar antenna. They are also used in many other applications such as signal generator protection circuits and transmitter injection locking circuits, for example. With the great increase in use of planar circuitry using microstrip transmission lines in millimeter wave frequency application because of the resulting reduction in size and weight of the equipment involved, a need has arisen for a Y-junction circulator which is suitable for use with such planar circuitry and microstrip transmission lines.

Conventional millimeter wave microstrip circulator designs generally utilize a small ferrite disc or "puck" which has metallized ends and which is disposed in a hole in the microstrip transmission line substrate at the point where the microstrip lines to be coupled meet. The puck has a thickness which is equal to the thickness of the microstrip transmission line substrate so that the metallized ends of the puck may be electrically connected to the microstrip conductors and the metal ground plane of the transmission line. When a unidirectional magnetic field is applied between the ends of the puck, a clockwise or counterclockwise non-reciprocal coupling action is produced between the microstrip lines which are joined at the puck. The clockwise or counterclockwise coupling direction may be reversed by reversing the direction of the applied magnetic field. A circulator of this type is shown and described in U.S. Pat. No. 3,456,213 issued July 15, 1969.

The manufacturing and assembly costs of the puck-type circulators are relatively high because the ferrite puck must be fitted into the substrate hole with a very close tolerance fit to minimize line impedance variations and to reduce insertion losses. Additionally, if the dielectric constant of the microstrip substrate is different from the dielectric constant of the ferrite, a matching transformer configuration is required which further increases the aforementioned costs. Furthermore, the ferrite puck arrangement is not readily adapted to the monolithic design and automated assembly techniques which must be utilized in the fabrication of microstrip circuits in order to reduce their complexity and cost.

SUMMARY OF THE INVENTION

It is an object of this invention to provide a microstrip Y-junction millimeter wave circulator of relatively simple design which readily lends itself to monolithic fabrication and automated assembly techniques.

It is a further object of this invention to provide a microstrip Y-junction millimeter wave circulator which is relatively inexpensive to manufacture and to assemble.

It is a still further object of this invention to provide a microstrip Y-junction millimeter wave circulator which may be installed in microstrip transmission line applications with a simple "drop-in" assembly technique and which avoids the close tolerance fitting techniques required for conventional circulators.

It is an additional object of this invention to provide a microstrip Y-junction millimeter wave circulator which eliminates the need for impedance matching transformers.

It is another object of this invention to provide a microstrip Y-junction millimeter wave circulator which minimizes transmission line impedance variations and which exhibits a low insertion loss and high isolation over an acceptable bandwidth in the millimeter wave frequency region.

Briefly, the microstrip Y-junction circulator of the invention comprises a microstrip dielectric substrate which has planar top and bottom surfaces and an electrically conductive ground plane mounted on the bottom surface of the substrate. A wye-shaped ferrite element is mounted on the top surface of the substrate and has a central portion shaped as a right prism having three rectangular prism faces of equal area and top and bottom prism bases shaped as eqilateral triangles. The bottom prism base abuts the top surface of the substrate. The ferrite element also has three arm portions which extend radially outwardly from the prism faces. Each of the arm portions have a width equal to the width of the prism face from which it extends and a height which decreases linearly from the full height of the top prism base above the bottom prism base at the end of the arm which abuts the prism face to zero height at the other end of the arm, so that the top surface of each of the arm portions slopes downwardly from the top base of the prism-shaped central portion and the bottom surface of each arm portion is coplanar with the bottom base of the prism-shaped central portion and abuts the top surface of the substrate. Electrically conductive microstrip conductor means are associated with each of the ferrite element arm portions and have a first portion thereof mounted on the top base of the prism-shaped central portion of the ferrite element, a second portion thereof extending down the sloping top surface of the ferrite element arm portion associated therewith and a third portion thereof mounted on the top surface of the substrate in alignment with the ferrite element arm portion associated therewith. Magnetic biasing means are provided for applying a unidirectional or "dc" magnetic field between the top and bottom prism bases of the prism-shaped central portion of the ferrite element to cause the ferrite element central portion to act as a circulator and the third portions of the microstrip conductor means to act as circulator ports therefor.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
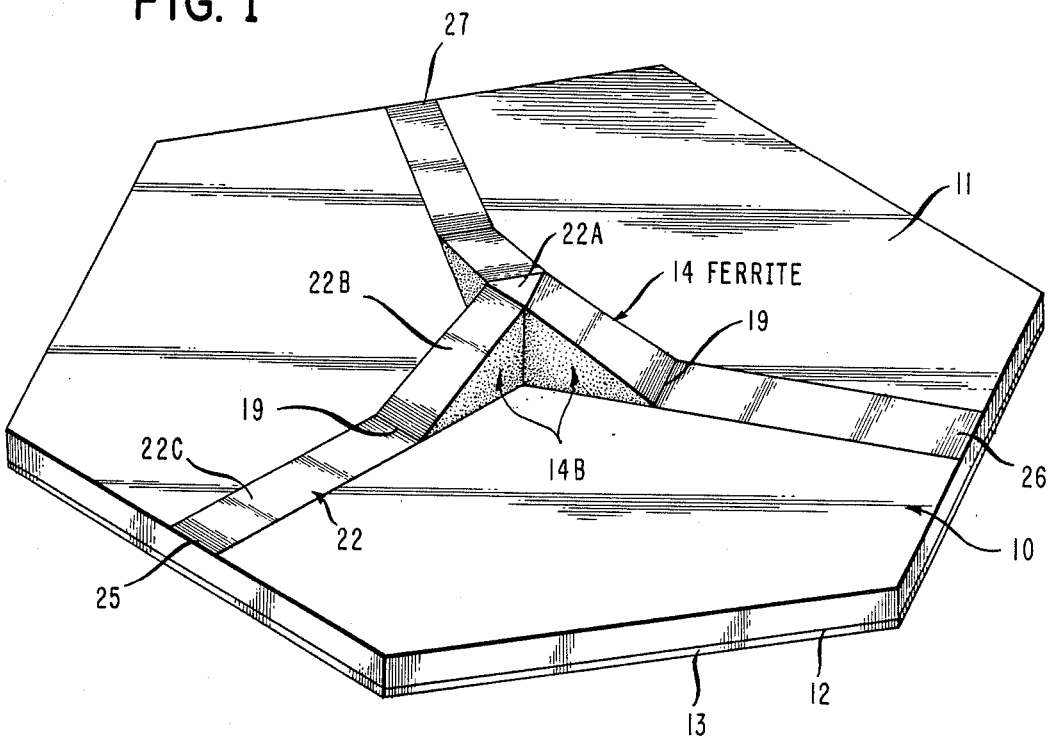
FIG. 1 is a perspective view of the microstrip Y-junction circulator of the invention.
Figure 4:
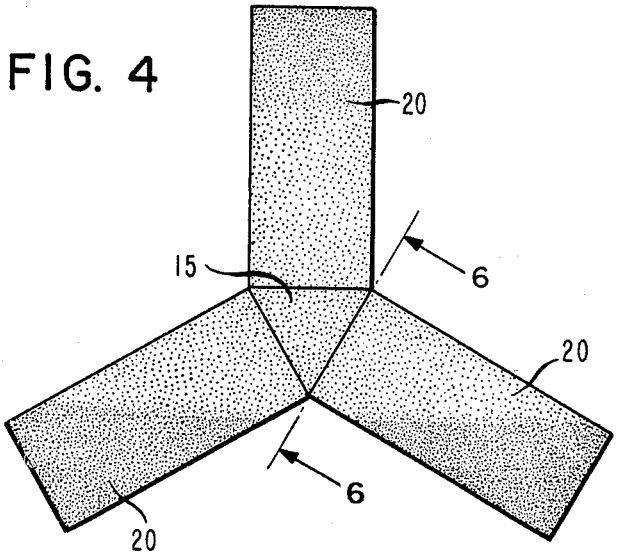
FIG. 4 is a top plan view of the wye-shaped ferrite element shown in FIG.3.
Figure 5:
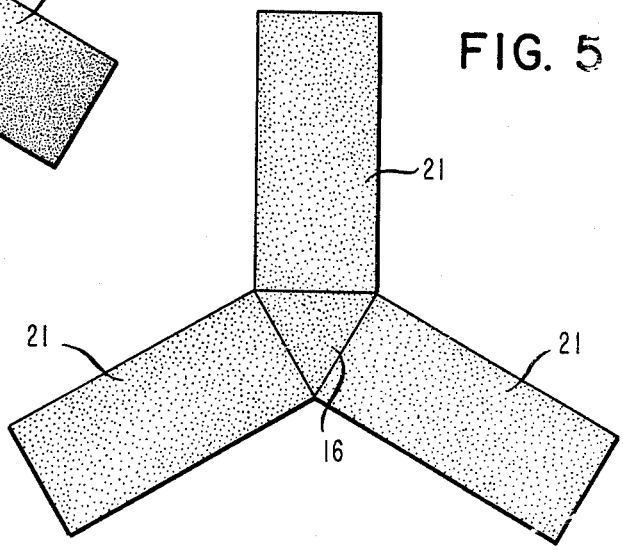
FIG. 5 is a bottom plan view of the wye-shaped ferrite element shown in FIG. 3.
Figure 3:
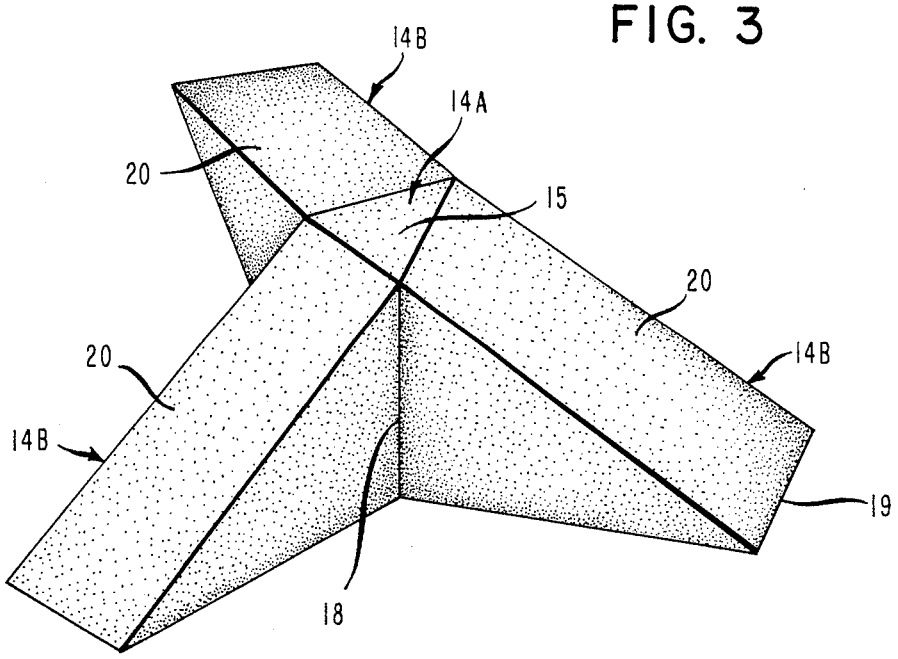
FIG. 3 is a perspective view of the wye-shaped ferrite element which is mounted on the substrate of the circulator of FIGS. 1 and 2.
Figure 2:
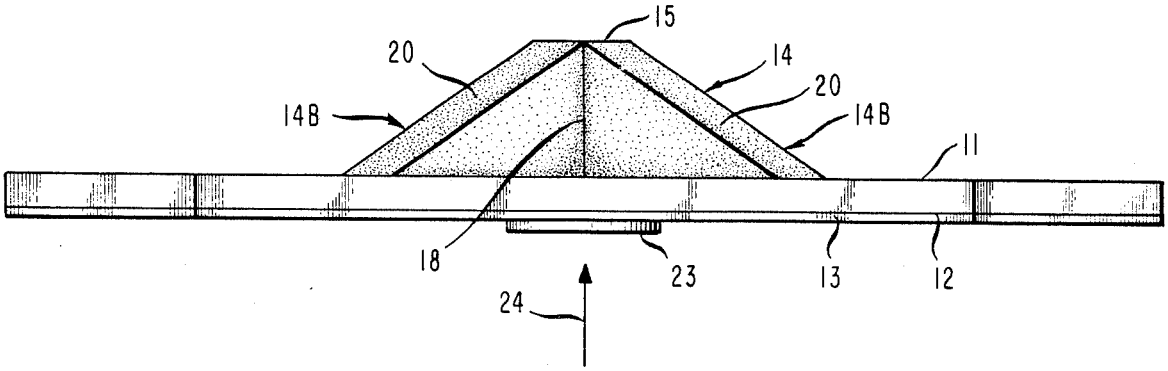
FIG. 2 is a front elevational view of the circulator of FIG. 1 with the microstrip conductor means omitted for clarity of illustration.

Referring now to FIGS. 1 and 2 of the drawings, there is shown a microstrip Y-junction circulator constructed in accordance with the present invention comprising a microstrip dielectric substrate, indicated generally as 10, which has a planar top surface 11 and a planar bottom surface 12. The substrate 10 may comprise a section of conventional microstrip transmission line substrate which is usually fabricated of duroid or other similar dielectric material having a relatively low dielectric constant. An electrically conductive ground plane 13 which is fabricated of a good conducting metal, such as copper or silver, for example, is mounted on the bottom surface 12 of the substrate and covers that entire surface.

Figure 6:
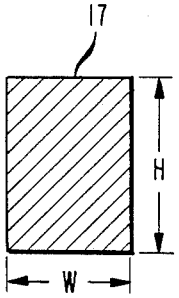
FIG. 6 is a full sectional view taken along the line 6—6 of FIG. 4 showing a prism face.

A wye-shaped ferrite element, indicated generally as 14, is mounted on the top surface 11 of the substrate 10. The element 14 may be fabricated of a ferrite material, such as nickel zinc or lithium ferrite, for example, which exhibits gyromagnetic behavior in the presence of a unidirectional magnetic field. As may be seen in FIGS. 3–6 of the drawings, although the ferrite element 14 is shown as a monolithic structure, it may be thought of as having a central portion, indicated generally as 14A, which is shaped as a right prism and three arm portions, indicated generally as 14B, which extend radially outwardly from the central portion. The prism-shaped central portion 14A has a top prism base 15 and a bottom prism base 16, each of which is shaped as an equilateral triangle. The bottom prism base 16 abuts the top surface 11 of the substrate 10. The prism-shaped central portion 14A has three rectangular prism "faces" 17 of equal area as shown in FIG. 6 of the drawings. The three arm portions 14B extend radially outwardly from the three prism faces 17. Each of the arm portions 14B has a width which is equal to the width W of the prism face 17 from which it extends and a height which decreases linearly from the full height H of the top prism base above the bottom prism base at the end 18 of the arm which abuts the prism face 17 to zero height at the other end 19 of the arm, so that the top surface 20 of each of the arm portions slopes downwardly from the top base 15 of the central portion 14A and the bottom surface 21 of each arm portion is coplanar with the bottom base 16 of the central portion 14A. The bottom surface 21 of each arm portion abuts the top surface 11 of the substrate 10 together with the bottom prism base 16 so that all of the bottom surfaces of the ferrite element 14 are coplanar.

Referring again to FIG. 1 of the drawings, it will be seen that each of the arm portions 14B of the ferrite element 14 has electrically conductive microstrip conductor means, indicated generally as 22, associated therewith. Each microstrip conductor means has a first portion 22A thereof which is mounted on the top base 15 of the prism-shaped central portion 14A of the ferrite element, a second portion 22B thereof which extends down the sloping top surface 20 of the ferrite element arm portion associated therewith and a third portion 22C thereof which is mounted on the top surface 11 of the microstrip substrate 10 in alignment with the ferrite element arm portion associated therewith. Since the top and bottom prism bases 15 and 16, respectively, are shaped as equilateral triangles, it follows that each of the arm portions 14B of the ferrite element 14 and the portion 22C of the microstrip conductor means associated with that arm portion are spaced 120 degrees apart in a Y-junction oriented configuration on the top surface 11 of the substrate 10. The microstrip conductor means 22 should again be fabricated of a good electrically conductive metal, such as copper or silver, for example.

As seen in FIG. 2 of the drawings, a small, high-energy permanent magnet 23 is mounted on the ground plane 13 directly below the bottom prism base 16 of the central portion 14A of the ferrite element 14. The permanent magnet 23 may be cylindrical and should have a diameter which is sufficient to cover the entire bottom prism-base 16 of the central portion 14A of the ferrite element so that a unidirectional or dc magnetic field is applied between the top and bottom prism bases 15, 16 of the prism-shaped central portion 14A of the ferrite element as indicated schematically by the arrow 24 in FIG. 2. The permanent magnet 23 may obviously be replaced by a permanent magnet of different shape or by some other magnetic biasing means which will provide the necessary unidirectional magnetic field 24.

By virtue of the foregoing arrangement, the central portion 14A of the ferrite element 14 in conjunction with the applied unidirectional magnetic field from the permanent magnet 23 acts as a ferrite circulator with respect to electromagnetic wave energy applied to the three prism faces 17 of the central portion 14A. The operation of a ferrite circulator of this type is described in U S. Pat. No. 4,415,871 which was issued to the inventors of the present invention on Nov. 15, 1983 and is assigned to the assignee of the present application. The three portions 22C of the microstrip conductor means 22 act as the three ports, designated 25, 26 and 27, of the microstrip circulator as shown in FIG. 1 of the drawings. Each of these short lengths of microstrip conductor 22C in combination with the microstrip substrate 10 and the ground plane 13 form a separate microstrip transmission line as is well known in the art and may be easily coupled to the microstrip transmission lines or other planar circuits which are to be selectively coupled by the microstrip circulator of the the invention. The three arm portions 14B of the ferrite element 14 act as transitions to bridge the height difference between the microstrip dielectric substrate 10, which is usually 0.010 inch thick, and the prism-shaped central portion 14A of the ferrite element which may have a height H on the order of 0.070 inch, for example. The portions 22A and 22B of the microstrip conductor means 22 act in conjunction with the microstrip substrate 10 and the ground plane 13 to convey millimeter wave signals which may be applied to the circulator ports 25, 26 and 27 to the prism-shaped central portion 14A of the ferrite element. Since the dielectric constant of the ferrite material is usually much higher than the dielectric constant of the microstrip substrate material, when the applied signals reach the portion 22A of the microstrip conductor means they are captured by the ferrite material of the central portion 14A.

Figure 7:
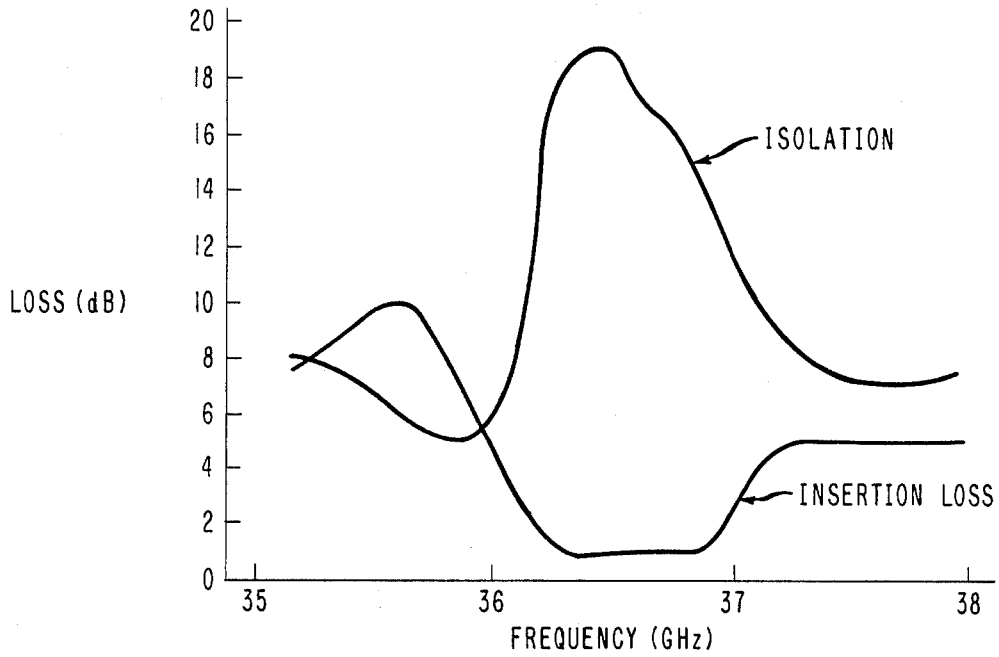
FIG. 7 is a graph showing isolation and insertion loss as a function of frequency over a selected frequency range for a prototype microstrip Y-junction circulator constructed in accordance with the teachings of the invention.
Figure 8:
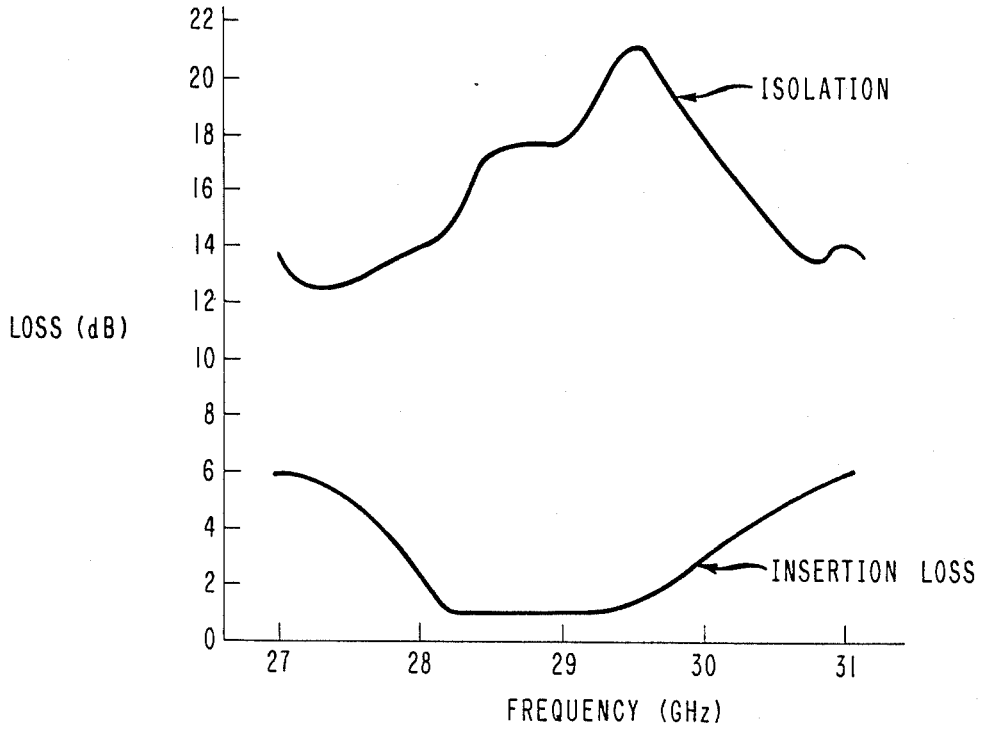
FIG. 8 is a graph showing isolation and insertion loss as a function of frequency over a different frequency range for another prototype constructed in accordance with the teachings of the present invention.

FIGS. 7 and 8 of the drawings show the isolation and insertion loss characteristics of two prototype circulators constructed in accordance with the present invention. As seen in FIG. 7, one of the prototype units exhibited a 1 db insertion loss with isolation which was greater than 15 db over a 0.5 GHz bandwidth operating near 36 GHz. In FIG. 8, it may be seen that the other prototype unit constructed exhibited similar insertion loss and isolation characteristics over a bandwidth which was in excess of 1 GHz operating at 29 GHz. The circulator bandwidths shown in FIGS. 7 and 8, however, may be considered to be conservative because the voltage standing wave ratio (VSWR) of certain metal waveguide to microstrip transitions used in the test equipment for measuring the performance of the prototype units varied across the operating region in a manner which degraded the isolation and insertion loss of the prototype circulators being tested.

In the prototype circulators tested, the wye-shaped ferrite element 14 was fabricated by ultrasonically cutting it out of a 0.070 inch slab of nickel zinc ferrite. The downwardly sloping arm portions 14B of the ferrite element 14 were obtained by grinding the arm portions after the wye-shaped element was cut from the slab of ferrite. The portions 22A and 22B of the microstrip conductor means which are disposed on the top surfaces of the ferrite element were formed by a sputtering technique so that these portions in effect constituted a single length of microstrip conductor for each arm portion 14B. The wye-shaped ferrite element 14 was then dropped into place on a prepared microstrip substrate fabricated of duroid and containing the three, 120 degree-spaced apart portions 22C of the microstrip conductor means and a suitable ground plane. The ends of the portions 22C of the microstrip conductor means on the substrate surface were then soldered to the corresponding ends of the microstrip conductor means portions on the top surfaces of the wye-shaped ferrite element 14. The assembly was completed by placing a small, high energy permanent magnet on the ground plane to provide the necessary unidirectional magnetic field for the circulator action. If desired, the ferrite element may be bonded by an epoxy cement or other suitable bonding material to the substrate surface to insure good mechanical rigidity.

It may be seen from the foregoing description of the assembly technique employed for the aforementioned prototypes that the overall design of the microstrip circulator of the invention readily lends itself to automated assembly techniques and that the close tolerance fitting operation required for existing microstrip circulators has been eliminated in favor of a simple "drop-in" assembly step. The ferrite element 14 itself is monolithic in construction because the central portion 14A and the three arm portions 14B are integral parts of the element. Accordingly, the ferrite element could be produced in production quantities by molding ferrite powder into the required size and shape and then firing it into final form. Although the ferrite element central portion 14A and the arm portions 14B could be fabricated separately and then bonded together, the insertion of the necessary bond would probably increase the impedance and overall insertion loss somewhat of the microstrip circulator to no advantage. Despite the fact that the ferrite circulator element has a substantially greater thickness than the thickness of the microstrip substrate and that it has been placed on top of the substrate which should cause a substantial increase in the impedance of the three microstrip transmission lines which are coupled by the ferrite element, it has been found that the actual impedance change is minimal so that there is no need for impedance matching transformers or other similar devices. Although the overall increase in thickness of the dielectric material between the microstrip conductors and the ground plane causes the impedance of the three microstrip sections to increase, the overall dielectric constant of the this material is also increasing because the dielectric constant of the ferrite material is so much greater than the dielectric constant of the microstrip substrate material. For example, the nickel zinc ferrite mentioned has a dielectric constant of 13 while the duroid substrate has a dielectric constant of 2.2. Thus, there is a trade off between impedance gain and loss which substantially balances each other out for a minimal resultant impedance change.

It is believed apparent that many changes could be made in the construction and described uses of the foregoing microstrip Y-junction circulator and many seemingly different embodiments of the invention could be constructed without departing from the scope thereof. For example, although the circulator of the invention has been described with reference to use in the millimeter wave region of the frequency spectrum, it is apparent that the circulator is not limited in use to applications in this frequency region. Accordingly, it is intended that all matter contained in the above description or shown in the accompanying drawings, shall be interpreted as illustrative and not in a limiting sense.

What is claimed is:

1. A microstrip Y-junction circulator comprising a microstrip dielectric substrate having planar top and bottom surfaces;

an electrically conductive ground plane mounted on the bottom surface of said substrate;

a wye-shaped ferrite element mounted on the top surface of said substrate, said ferrite element having a central portion shaped as a right prism having three rectangular prism faces of equal area and top and bottom prism bases shaped as equilateral triangles, said bottom prism base abutting the top surface of said substrate, and three arm portions extending radially outwardly from said prism faces, each of said arm portions having a width equal to the width of the prism face from which it extends and a height which decreases linearly from the full height of the top prism base above the bottom prism base at the end of the arm which abuts the prism face to zero height at the other end of the arm, so that the top surface of each of said arm portions slopes downwardly from the top base of said prism-shaped central portion and the bottom surface of each arm portion is coplanar with the bottom base of said prism-shaped central portion and abuts the top surface of said substrate;

electrically conductive microstrip conductor means associated with each of said ferrite element arm portions, said microstrip conductor means having a first portion thereof mounted on the top base of the prism-shaped central portion of said ferrite element, a second portion thereof extending down the sloping top surface of the ferrite element arm portion associated therewith and a third portion thereof mounted on the top surface of said substrate in alignment with the ferrite element arm portion associated therewith; and magnetic biasing means for applying a dc magnetic field between the top and bottom prism bases of the prism-shaped central portion of said ferrite element to cause said ferrite element central portion to act as a circulator and said third portions of said microstrip conductor means to act as circulator ports therefor.

2. A microstrip Y-junction circulator as claimed in claim 1 wherein said ferrite element central portion and said ferrite element arm portions are integral parts of said ferrite element so that said ferrite element is monolithic in construction.

3. A microstrip Y-junction circulator as claimed in claim 1 wherein each of said microstrip conductor means comprises a first length of electrically conductive microstrip conductor forming said first and second portions thereof, and a second length of electrically conductive microstrip conductor forming said third portion thereof, said first and second lengths of microstrip conductor being electrically interconnected at said other end of the ferrite element arm portion associated therewith.

4. A microstrip Y-junction circulator as claimed in claim 1 wherein each of said microstrip conductor means comprises a single length of electrically conductive microstrip conductor forming said first, second and third portions thereof.

5. A microstrip Y-junction circulator as claimed in claim 1 wherein said magnetic biasing means comprises permanent magnet means mounted on said ground plane beneath the bottom base of said ferrite element central portion.

* * * * *